US006498469B2

(12) United States Patent
Kobayashi

(10) Patent No.: US 6,498,469 B2
(45) Date of Patent: Dec. 24, 2002

(54) INTERNAL SUPPLY VOLTAGE GENERATING CIRCUIT AND METHOD OF GENERATING INTERNAL SUPPLY VOLTAGE USING AN INTERNAL REFERENCE VOLTAGE GENERATING CIRCUIT AND VOLTAGE-DROP REGULATOR

(75) Inventor: Isamu Kobayashi, Kasugai (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/772,081

(22) Filed: Jan. 30, 2001

(65) Prior Publication Data

US 2001/0011886 A1 Aug. 9, 2001

(30) Foreign Application Priority Data

Jan. 31, 2000 (JP) ..... 2000-022153

(51) Int. Cl.[7] ..... G05F 3/16
(52) U.S. Cl. ..... 323/313; 323/354
(58) Field of Search ..... 323/313, 314, 323/350, 354

(56) References Cited

U.S. PATENT DOCUMENTS 5,539,771 A * 7/1996 Noda et al. ..... 375/219
5,982,163 A 11/1999 Shinozaki ..... 323/354
6,163,191 A * 12/2000 Miyagi ..... 327/208
6,307,801 B1 * 10/2001 Ogawa et al. ..... 365/226

* cited by examiner

*Primary Examiner*—Adolf Deneke Berhane
(74) *Attorney, Agent, or Firm*—Arent Fox Kinter Plotkin & Kahn, PLLC

(57) ABSTRACT

The internal supply voltage generating circuit includes a level trimming circuit for regulating a first reference voltage and generating a predetermined second reference voltage, and an internal reference voltage generating circuit connected to the level trimming circuit, for generating internal reference voltages using the predetermined second reference voltage. The internal supply voltage generating circuit prevents the circuit area from increasing, reduces a variation in a load when regulating a feedback voltage, and generates a plurality of highly accurate internal supply voltages.

19 Claims, 9 Drawing Sheets

INTERNAL SUPPLY VOLTAGE GENERATING CIRCUIT AND METHOD OF GENERATING INTERNAL SUPPLY VOLTAGE USING AN INTERNAL REFERENCE VOLTAGE GENERATING CIRCUIT AND VOLTAGE-DROP REGULATOR

BACKGROUND OF THE INVENTION

The present invention relates to an internal supply voltage generating circuit and a method of generating an internal supply voltage. More particularly, it relates to an internal supply voltage generating circuit in a semiconductor memory device and an internal supply voltage generating method, which generate an internal supply voltage by dropping an external supply voltage and provide the individual circuits of the semiconductor memory device with the generated internal supply voltage.

Due to the micronization of the wiring pattern and the reduction in power consumption, a semiconductor memory device is provided with an internal supply voltage generating circuit which drops an external supply voltage to generate an internal supply voltage to be supplied to the individual internal circuits. The internal supply voltage generating circuit includes a reference voltage generating circuit and a voltage-drop regulator.

The reference voltage generating circuit generates a desired reference voltage from the external supply voltage and supplies the reference voltage to the voltage-drop regulator. The voltage-drop regulator receives the reference voltage and the external supply voltage and generates a stable internal supply voltage by dropping the external supply voltage in accordance with the reference voltage. The voltage-drop regulator supplies the internal supply voltage to various internal circuits via internal power lines.

It is desirable that a variation in the internal supply voltage be as small as possible. Therefore, the reference voltage, which is supplied to the voltage-drop regulator, should preferably have a high precision. However, there is a current of several micro amperes flowing in the reference voltage generating circuit and the threshold values of the individual transistors of the reference voltage generating circuit are not constant due to a productional variation. This results in a variation in reference voltage.

As a solution to reduce the variation in reference voltage, an internal supply voltage generating circuit having an internal reference generating circuit connected between a reference voltage generating circuit and a voltage-drop regulator has been proposed. The internal reference generating circuit regulates the reference voltage to a desired voltage and supplies the regulated reference voltage to the voltage-drop regulator.

FIG. 1 is a schematic block diagram of a conventional internal supply voltage generating circuit 50. The internal supply voltage generating circuit 50 includes a reference voltage generating circuit 51, an internal reference generating circuit 52 and a voltage-drop regulator 53.

The reference voltage generating circuit 51 generates a desired first reference voltage Vflat1 from an external supply voltage Vcc and supplies the first reference voltage Vflat1 to the internal reference generating circuit 52. The internal reference generating circuit 52 generates a second reference voltage Vflat2 using the first reference voltage Vflat1.

As shown in FIG. 2, the internal reference generating circuit 52 includes a differential amplifier 56, a driver 57, a trimming circuit 58 and a phase compensation circuit 59.

The differential amplifier 56 includes a differential amplification section which comprises a first N channel MOS (NMOS) transistor Q1 and a second NMOS transistor Q2, as shown in FIG. 3. The sources of the NMOS transistors Q1 and Q2 are grounded via a current-controlling NMOS transistor Q3. The gate of the NMOS transistor Q3 is connected to the gate of the first NMOS transistor Q1.

The drains of the NMOS transistors Q1 and Q2 are connected to an external supply voltage Vcc via P channel MOS (PMOS) transistors Q4 and Q5 respectively. The gates of the PMOS transistors Q4 and Q5 are connected together to the drain of the second NMOS transistor Q2.

The first reference voltage Vflat1 from the reference voltage generating circuit 51 is supplied to the gate of the first NMOS transistor Q1. A feedback voltage Vf from the trimming circuit 58 is supplied to the gate of the second NMOS transistor Q2. The drain of the first NMOS transistor Q1 also serves as the output terminal of the differential amplifier 56, which is connected to the driver 57.

The driver 57 includes a PMOS transistor Q6 whose gate is supplied with an output voltage Vout of the differential amplifier 56. The source of the PMOS transistor Q6 is connected to the external supply voltage Vcc and the drain of the PMOS transistor Q6 is connected to the voltage-drop regulator 53. The second reference voltage Vflat2 is supplied to the voltage-drop regulator 53 (in FIG. 1) from the drain of the PMOS transistor Q6. The drain of the PMOS transistor Q6 is grounded via the trimming circuit 58.

The trimming circuit 58 includes a voltage dividing circuit, which includes four resistors R1 to R4, and a selection circuit. The selection circuit includes three transfer gates G1 to G3, each connected between the individual nodes between one of the resistors R1–R4 of the voltage dividing circuit and the gate of the second NMOS transistor Q2 of the differential amplifier 56. One of the three transfer gates G1–G3 is turned on by selection signals $\phi$1 to $\phi$3 and the remaining two transfer gates are turned off.

The divided voltage, which is produced by the voltage dividing circuit, is supplied via the turned-on transfer gate to the non-inverting input terminal (the gate of the second NMOS transistor Q2) of the differential amplifier 56 as the feedback voltage Vf.

The drain of the PMOS transistor Q6 is grounded via the phase compensation circuit 59. The phase compensation circuit 59 includes a resistor R5 and a capacitor Cl.

The differential amplifier 56 regulates the second reference voltage Vflat2 by raising or lowering the output voltage, such that the feedback voltage Vf substantially coincides with the first reference voltage Vflat1. That is, the differential amplifier 56 detects whether the second reference voltage Vflat2 is a predetermined voltage during a test conducted before shipment. When the second reference voltage Vflat2 is not the predetermined voltage, one of the three transfer gates G1–G3 is turned on to regulate the feedback voltage Vf, so that the second reference voltage Vflat2 is adjusted to the predetermined voltage. Therefore, (the voltage-drop regulator 53 produces a highly accurate and stable internal supply voltage Vdd in accordance with the second reference voltage Vflat2 whose productional variation has been compensated.

The phase compensation circuit 59 prevents the internal reference generating circuit 52 from performing an oscillating operation due to the phase shift of the feedback voltage Vf supplied to the differential amplifier 56.

A semiconductor memory device has a plurality of internal supply voltage generating circuits according to the usage of the internal supply voltage Vdd (e.g., the supply voltage for peripheral function circuits, the supply voltage for memory core circuits). Specifically, because of various factors such as the problems related to the withstand voltage and power consumption, which originat from the micro-fabrication process, power supply noise and the set level of the voltage-drop potential, a semiconductor memory device has an internal supply voltage generating circuit for input/output circuits, an internal supply voltage generating circuit for peripheral function circuits and an internal supply voltage generating circuit for a memory array, which are independently provided.

As shown in FIG. 4, a plurality of internal reference generating circuits 64, 65 and 66 are connected to one reference voltage generating circuit 51, and a plurality of voltage-drop regulators 61, 62 and 63 are respectively connected to the internal reference generating circuits 64, 65 and 66. The internal reference generating circuits 64, 65 and 66 respectively generate second reference voltages Vflat2*a*, Vflat2*b* and Vflat2*c* using a first reference voltage Vflat1. The voltage-drop regulators 61, 62 and 63 respectively generate internal supply voltages Vdda, Vddb and Vddc from the second reference voltages Vflat2*a*, Vflat2*b* and Vflat2*c*.

In this case, however, the provision of the plurality of internal reference generating circuits 64, 65 and 66 increases the circuit area.

As a solution to this shortcoming, as shown in FIG. 5, a single internal reference generating circuit 67, which generates a plurality of second reference voltages Vflat2*a*, Vflat2*b* and Vflat2*c*, has been proposed. Specifically, the second reference voltage Vflat2*a* is an output from the drain of the PMOS transistor Q6 of the driver 57. The second reference voltages Vflat2*b* and Vflat2*c* are outputs from arbitrary nodes between resistors R11 to R15 of the voltage dividing circuit of the trimming circuit 58.

In the trimming circuit 58, one of the three transfer gates G1–G3 is selected based on a variation in the first reference voltage Vflat1. Therefore, the loads of the voltage-drop regulators 62 and 63 are applied to the non-inverting input terminal of the differential amplifier 56 via the selected transfer gate. This significantly changes the load on the non-inverting input terminal of the differential amplifier 56. The phase compensation circuit 59 cannot compensate for a variation in the load, causing the internal reference generating circuit 67 to oscillate.

To make variations in the internal supply voltages Vdd, Vdda, Vddb and Vddc as small as possible, it is desirable to increase the number of resistors in the voltage dividing circuit of the trimming circuit 58. As shown in FIG. 6, a trimming circuit 70 includes a voltage dividing circuit having seventeen resistors Ra1 to Ra17 and a selection circuit having sixteen transfer gates Ga1 to Ga16. By selecting one of the transfer gates Ga1–Ga16, there are sixteen possible ways of selecting the feedback voltage Vf. This allows a variation in the first reference voltage Vflat1 to be adjusted more precisely, thus reducing variations in the internal supply voltages Vdd, Vdda, Vddb and Vddc. However, the overall circuit area is increased by the increases in the number of resistors in the voltage dividing circuit, the number of transfer gates in the selection circuit and the number of signal lines for the sixteen transfer gates Ga1–Ga16.

SUMMARY OF THE INVENTION

Accordingly, it is an object of the present invention to provide an internal supply voltage generating circuit that prevents the circuit area from increasing, reduces a variation in a load when regulating a feedback voltage, and generates a plurality of highly accurate internal supply voltages.

In one aspect of the present invention, an embodiment of an internal supply voltage generating circuit is provided. The internal supply voltage generating circuit includes a level trimming circuit for regulating a first reference voltage and generating a predetermined second reference voltage, and an internal reference voltage generating circuit. The latter is connected to the level trimming circuit, for generating one or more internal reference voltages using the predetermined second reference voltage.

In another aspect of the present invention, another embodiment of an internal supply voltage generating circuit is provided. The internal supply voltage generating circuit includes a level trimming circuit for regulating a first reference voltage and generating a predetermined second reference voltage. The level trimming circuit includes a voltage dividing circuit for dividing the second reference voltage and generating a plurality of divided voltages. The level trimming circuit regulates the first reference voltage using at least one divided voltage selected from the plurality of divided voltages as a feedback voltage. An internal reference voltage generating circuit is connected to the level trimming circuit to generate one or more internal supply voltages using the predetermined second reference voltage. A phase compensation circuit is connected between the level trimming circuit and the internal reference voltage generating circuit to compensate for a phase shift of the feedback voltage.

In yet another aspect of the present invention, a method for generating an internal supply voltage is provided. First, a first reference voltage is generated from an external supply voltage, and a predetermined second reference voltage is generated by regulating the first reference voltage. Compensating for a phase shift of the predetermined second reference voltage is performed to generate a compensated predetermined second reference voltage. A plurality of internal reference voltages are generated using the compensated predetermined second reference voltage. Then, a plurality of internal supply voltages are generated using the plurality of internal reference voltages.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently exemplary embodiments together with the accompanying drawings in which.

DETAILED DESCRIPTION OF THE PREFERRED EMBODIMENTS

Figure 7:
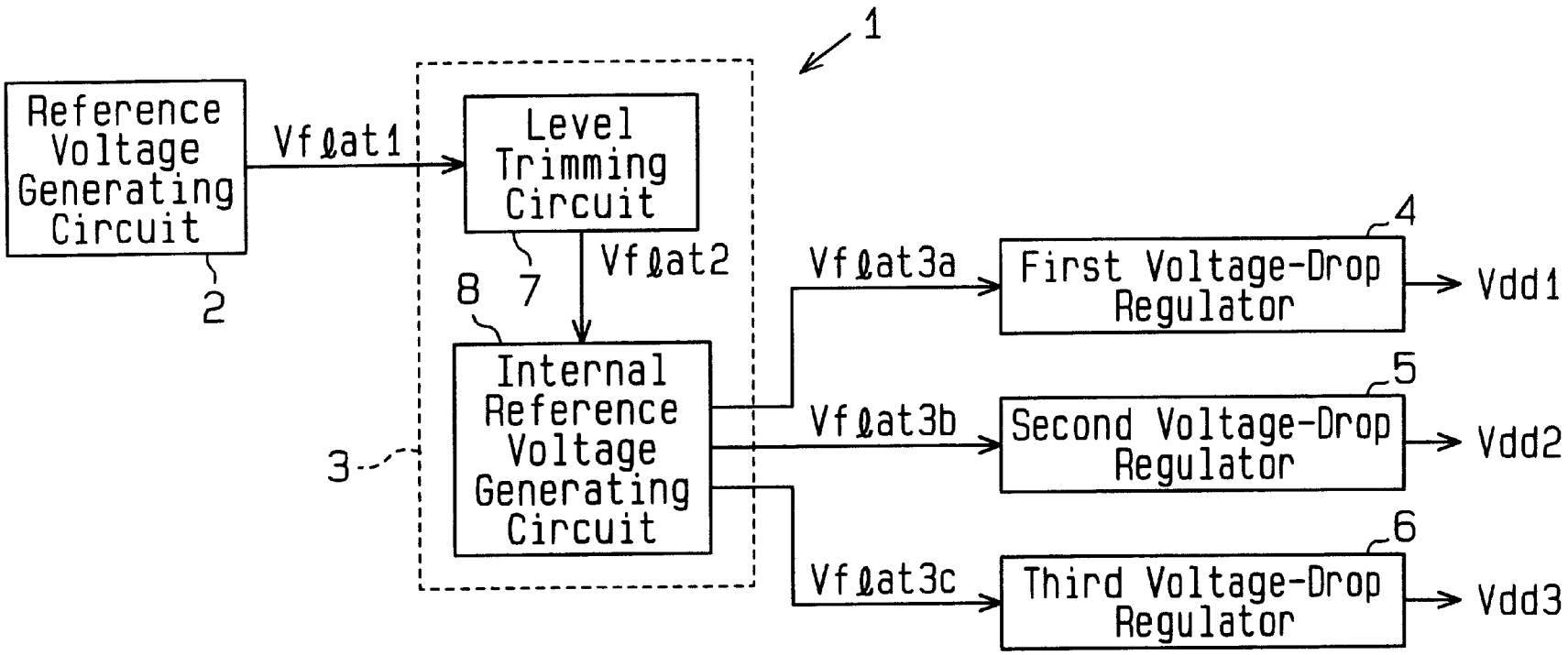
FIG. 7 is a schematic block circuit diagram of an internal supply voltage generating circuit according to a first embodiment of the present invention.

As shown in FIG. 7, an internal supply voltage generating circuit 1 according to a first embodiment of the present invention includes a reference voltage generating circuit 2, an internal reference generating circuit 3 and a plurality of voltage-drop regulators (three in this embodiment) 4, 5 and 6. The internal supply voltage generating circuit 1 is incorporated in a synchronous DRAM (SDRAM).

Figure 1:
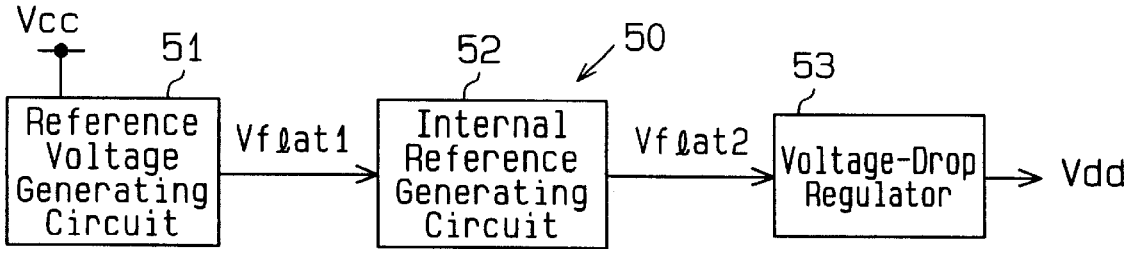
Fig.1 (Prior Art)
FIG. 1 is a schematic block diagram of an internal supply voltage generating circuit according to the prior art.
Figure 2:
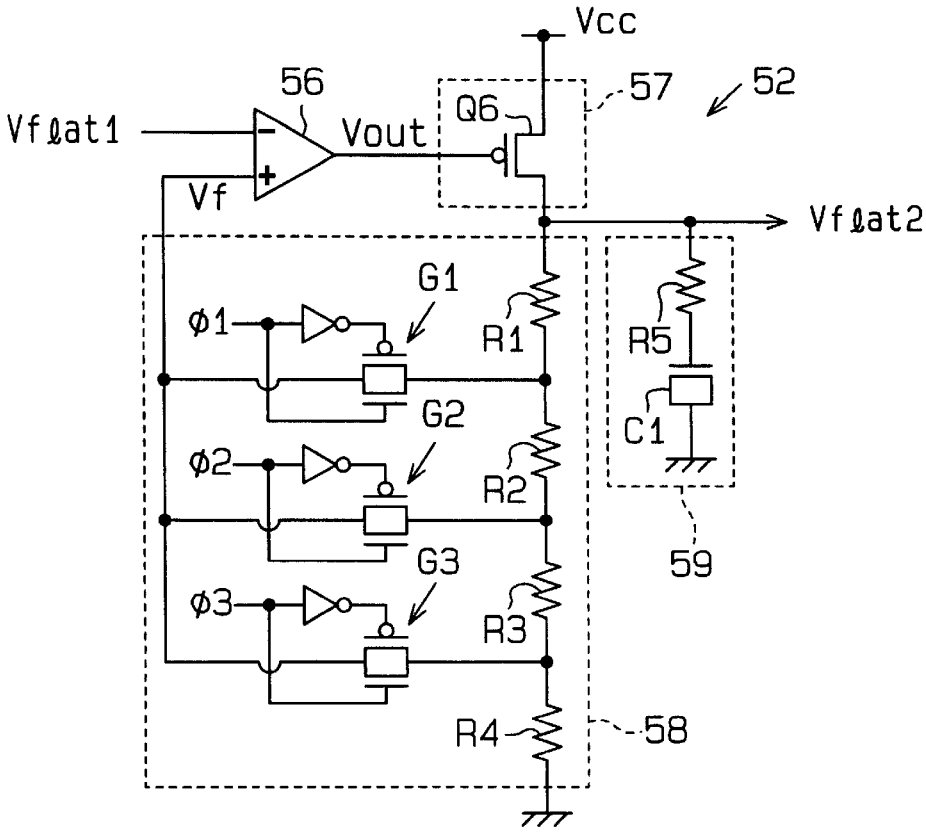
Fig.2 (Prior Art)
FIG. 2 is a schematic circuit diagram of an internal reference generating circuit of the internal supply voltage generating circuit of FIG. 1.

The reference voltage generating circuit 2, like the reference voltage generating circuit 51 of FIG. 1, receives an external supply voltage Vcc from an external device (not shown) and generates a first reference voltage Vflat1.

The internal reference generating circuit 3 includes a level trimming circuit 7 and an internal reference voltage generating circuit 8. The level trimming circuit 7 receives the first reference voltage Vflat1 from the reference voltage generating circuit 2 and produces a predetermined second reference voltage Vflat2 by regulating the first reference voltage Vflat1. The internal reference voltage generating circuit 8 receives the second reference voltage Vflat2 from the level trimming circuit 7 and generates three internal reference voltages Vflat3*a*, Vflat3*b* and Vflat3*c*.

The first voltage-drop regulator 4 receives the first internal reference voltage Vflat3*a* as a control signal from the internal reference voltage generating circuit 8 and drops the external supply voltage Vcc to generate a stable internal supply voltage Vdd1. The second voltage-drop regulator 5 receives the second internal reference voltage Vflat3*b* as a control signal from the internal reference voltage generating circuit 8 and drops the external supply voltage Vcc to generate a stable internal supply voltage Vdd2. The third voltage-drop regulator 6 receives the third internal reference voltage Vflat3*c* as a control signal from the internal reference voltage generating circuit 8 and drops the external supply voltage Vcc to generate a stable internal supply voltage Vdd 3.

Figure 8:
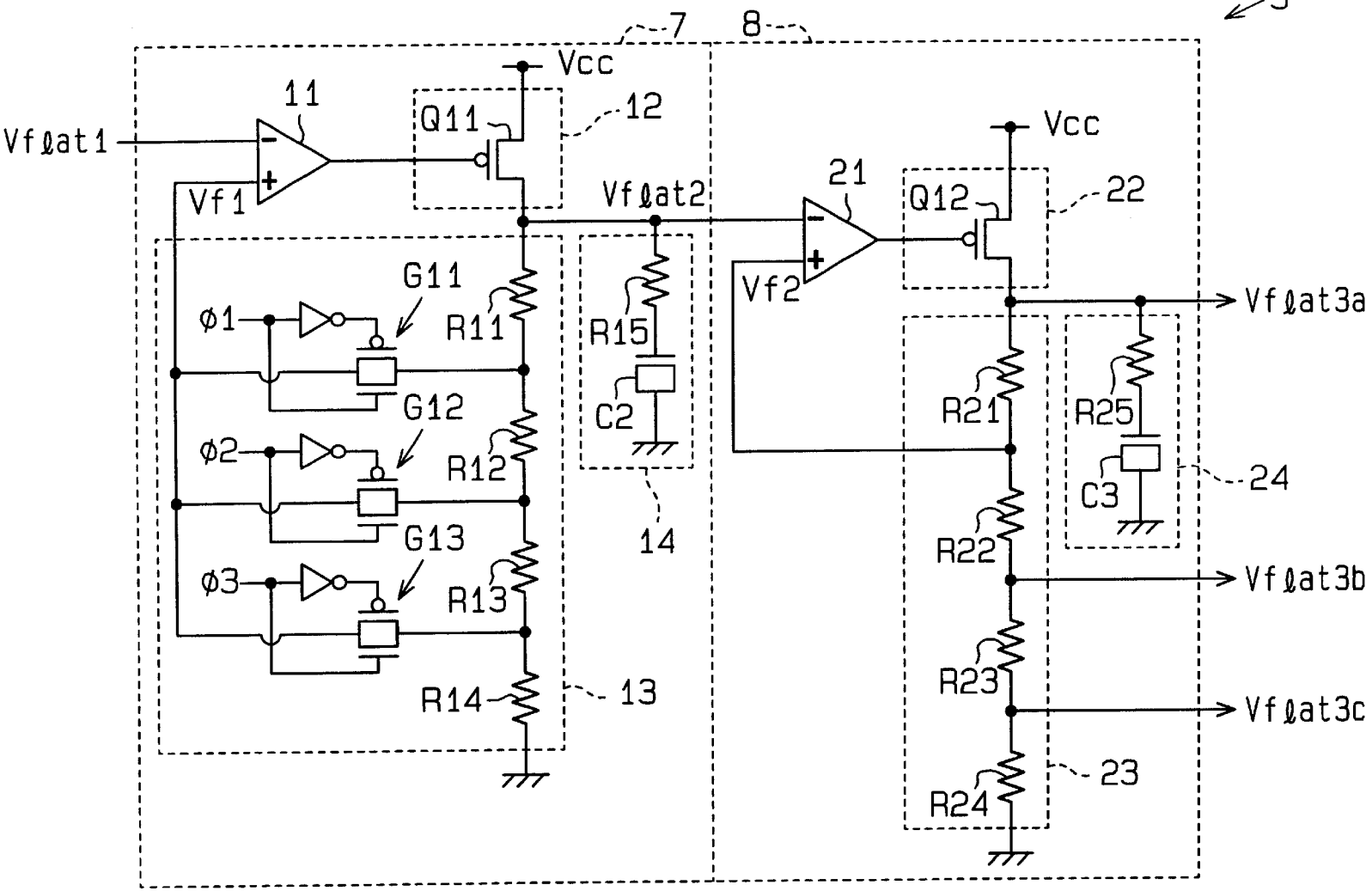
FIG. 8 is a schematic circuit diagram of an internal reference voltage generating circuit of the internal supply voltage generating circuit of FIG. 7.

As shown in FIG. 8, the level trimming circuit 7 includes a differential amplifier 11, a driver 12, a trimming circuit 13 and a phase compensation circuit 14.

Figure 3:
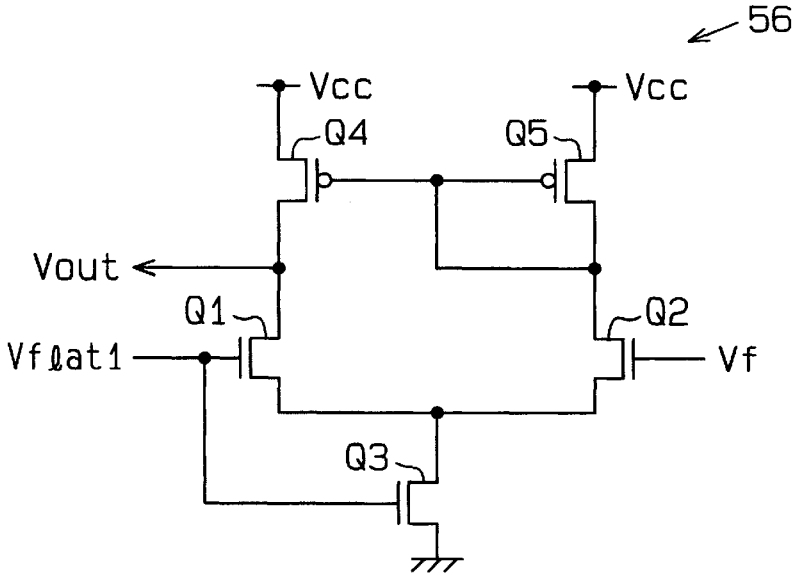
Fig.3 (Prior Art)
FIG. 3 is a schematic circuit diagram of a differential amplifier of the internal reference generating circuit of FIG. 1.
Figure 4:
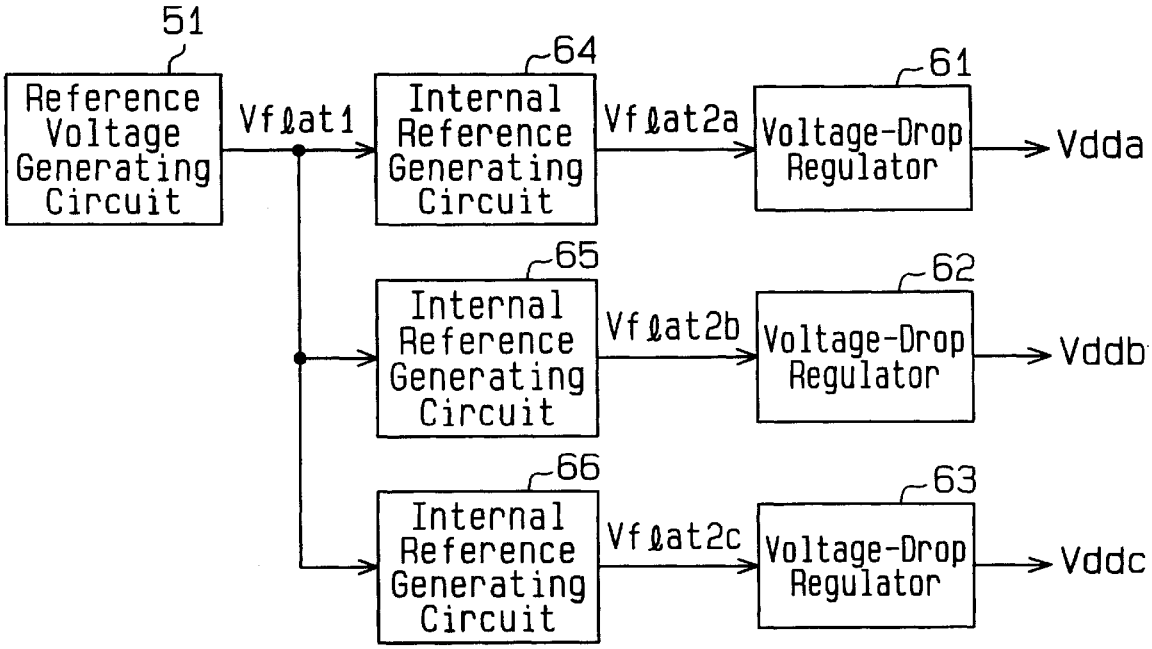
Fig.4 (Prior Art)
FIG. 4 is a schematic block diagram of an internal supply voltage generating circuit according to the prior art.
Figure 5:
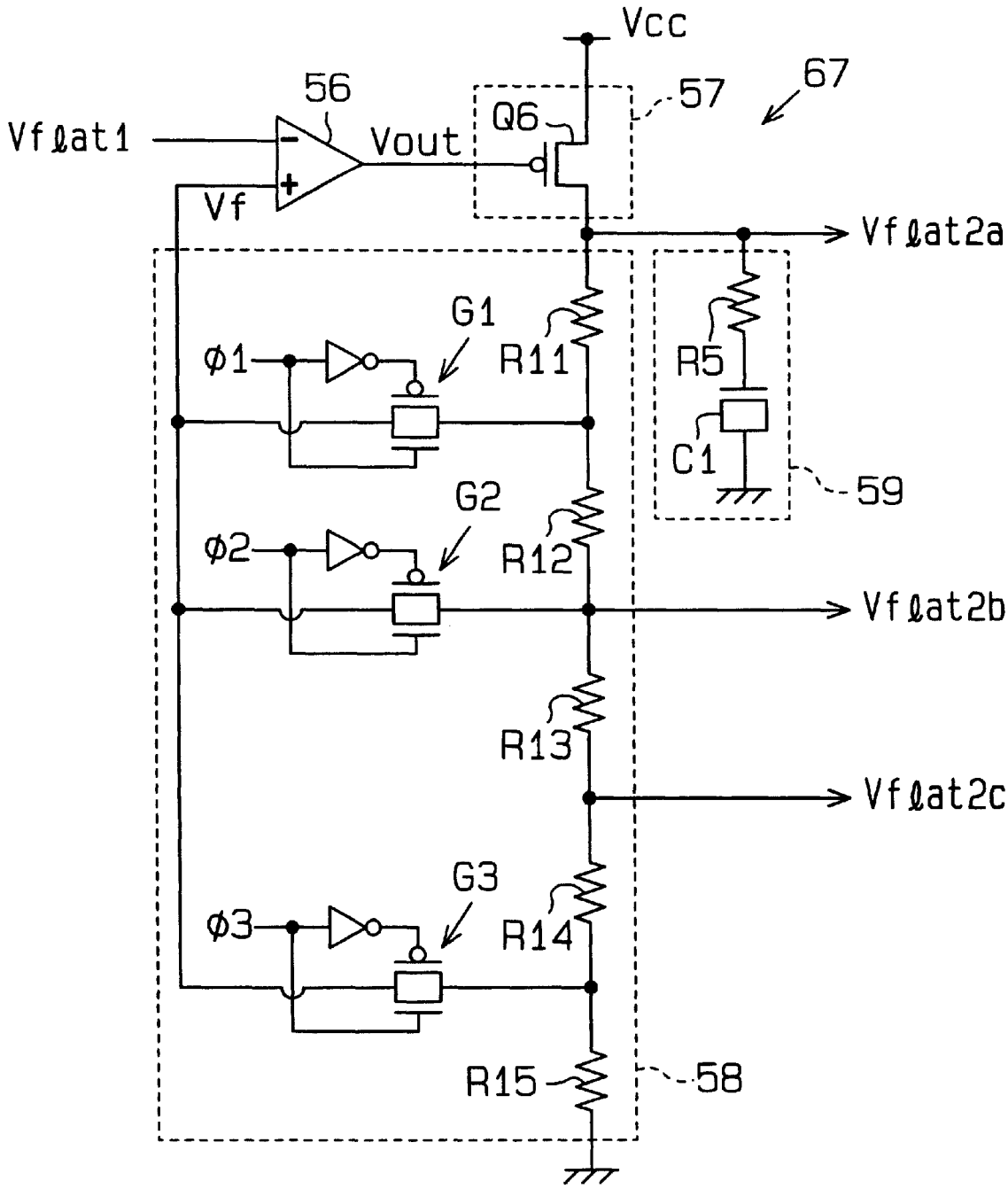
Fig.5 (Prior Art)
FIG. 5 is a schematic circuit diagram of an internal reference generating circuit according to the prior art.

The differential amplifier 11 is configured in the same way as the differential amplifier 56 of FIG. 3. The first reference voltage Vflat1 is supplied to the inverting (negative) input terminal of the differential amplifier 11. The driver 12 comprises a PMOS transistor Q11 whose gate is connected to the output terminal of the differential amplifier 11. The source of the PMOS transistor Q11 is connected to the external supply voltage Vcc and the drain of the PMOS transistor Q11 is connected to the internal reference voltage generating circuit 8. The drain voltage of the PMOS transistor Q11 is the second reference voltage Vflat2.

The drain of the PMOS transistor Q11 is grounded via the trimming circuit 13. The trimming circuit 13 includes four resistors R11, R12, R13 and R14, and three transfer gates G11, G12 and G13 each connected between the nodes between one of the resistors R11, R12, R13 and R14 and the non-inverting (positive) input terminal of the differential amplifier 11. The resistors R11, R12, R13 and R14 constitute a voltage dividing circuit, and the transfer gates G11–G13 constitute a selection circuit.

Selection signals $\phi$1–$\phi$3 are supplied to the transfer gates G11–G13 from a selection control circuit (not shown), serving to turn on one transfer gate and turn off the other two transfer gates. The divided voltage, which is generated at the associated nodes between the resistors, is supplied to the non-inverting input terminal of the differential amplifier as a feedback voltage Vf1 via the turned-on transfer gate. The selection signals $\phi$1–$\phi$3 are, for example, variable control signals according to an internal test mode signal or fixed control signals stored in a ROM. More than one transfer gate may be turned on by the selection signals $\phi$1–$\phi$3.

When the predetermined second reference voltage Vflat2 is not acquired due to a productional variation in a test conducted on a SDRAM before shipment, the second reference voltage Vflat2 is adjusted to a predetermined voltage by controlling the feedback voltage Vf1 by turning on one of the transfer gates G11–G13. Therefore, the second reference voltage Vflat2, whose productional variation has been compensated, is supplied to the internal reference voltage generating circuit 8.

The phase compensation circuit 14, which includes a resistor R15 and a capacitor C2, is connected between the drain of the PMOS transistor Q11 and the ground power line. The phase compensation circuit 14 compensates for the phase shift of the feedback voltage Vf1, which is supplied to the differential amplifier 11 via the trimming circuit 13, thereby preventing the oscillation of the level trimming circuit 7.

The internal reference voltage generating circuit 8 includes a differential amplifier 21, a driver 22, a voltage dividing circuit 23 and a phase compensation circuit 24.

The differential amplifier 21 has the same structure as the differential amplifier 56 of FIG. 3. The second reference voltage Vflat2 from the level trimming circuit 7 is supplied to the inverting input terminal of the differential amplifier 21. The driver 22 includes a PMOS transistor Q12 whose gate is connected to the output terminal of the differential amplifier 21. The source of the PMOS transistor Q12 is connected to the external supply voltage Vcc and its drain is connected to the first voltage-drop regulator 4 (in FIG. 7). The drain voltage of the PMOS transistor Q12 is the first internal reference voltage Vflat3*a*.

The voltage dividing circuit 23 is connected between the drain of the PMOS transistor Q12 and the ground. The voltage dividing circuit 23 includes four resistors R21 to R24 connected in series. A node between the resistors R21 and R22 is connected to the non-inverting input terminal of the differential amplifier 21, to which a feedback voltage Vf2 is supplied. One divided voltage, which is generated at a node between the resistors R22 and R23, is supplied to the second voltage-drop regulator 5 (of FIG. 7) as the second internal reference voltage Vflat3*b*. Another divided voltage, which is generated at a node between the resistors R23 and R24, is supplied to the third voltage-drop regulator 6 as the third internal reference voltage Vflat3*c*.

The first internal reference voltage Vflat3*a* is set to a predetermined voltage by the feedback voltage Vf2. The second and third internal reference voltages Vflat3*b* and Vflat3*c* are set to predetermined voltages by dividing the first internal reference voltage Vflat3*a*.

Because the differential amplifier 21 operates such that the feedback voltage Vf2 substantially coincides with the second reference voltage Vflat2, $$Vflat2 = Vf2$$

$$= Vflat3a \cdot (R22 + R23 + R24) / (R21 + R22 + R23 + R24)$$

Thus, $$V\text{flat}3a = V\text{flat}2 \cdot (R21 + R22 + R23 + R24) / (R22 + P23 + R24).$$

Given that R22+R23+R24=RA, then $$V\text{flat}3a = V\text{flat}2 \cdot (R21 + RA) / RA$$

Thus, $$Vflat3b = Vflat3a \cdot (R23 + R24) / (R21 + R22 + R23 + R24)$$

$$= Vflat2 \cdot (R23 + R24) / (R22 + R23 + R24)$$

$$Vflat3c = Vflat3a \cdot R24 / (R21 + R22 + R23 + R24)$$

$$= Vflat2 \cdot R24 / (R22 + R23 + R24)$$

Figure 9:
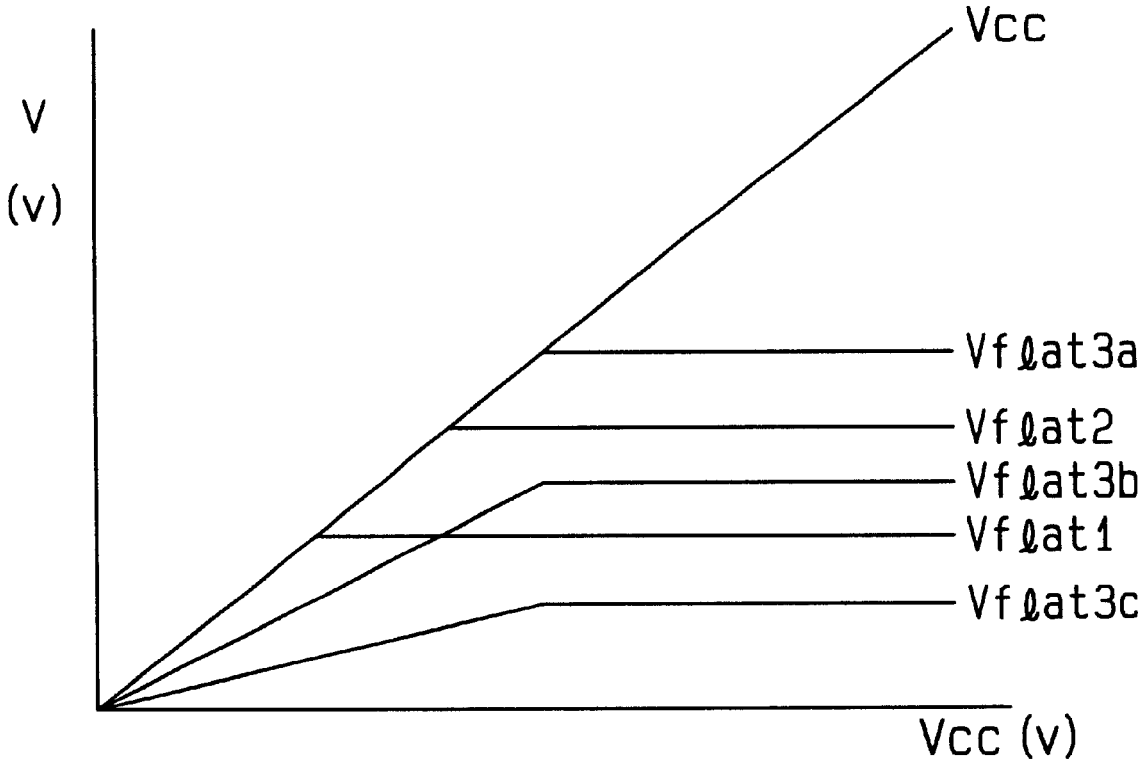
FIG. 9 is a graph showing the relationship between an external supply voltage and an internal reference voltage.

By setting the resistances of the resistors R21–R24 according to predetermined values, the internal reference voltage generating circuit 8 generates the desired first to third internal reference voltages Vflat3*a*, Vflat3*b* and Vflat3*c*, as shown in FIG. 9.

The phase compensation circuit 24, which includes a resistor R25 and a capacitor C3, is connected between the drain of the PMOS transistor Q12 and the ground. The phase compensation circuit 24 compensates for the phase shift of the feedback voltage Vf2, which is supplied to the differential amplifier 21 via the voltage dividing circuit 23, thereby preventing the oscillation of the internal reference voltage generating circuit 8.

The internal supply voltage generating circuit 1 shown in FIG. 7 according to the first embodiment has the following advantages.

(1) The internal reference voltage generating circuit 8 in the internal reference generating circuit 3 includes the voltage dividing circuit 23, which generates first to third internal reference voltages Vflat3*a*, Vflat3*b* and Vflat3*c* to be supplied to first to third voltage-drop regulators 4, 5 and 6 respectively. It is therefore unnecessary to provide a plurality of internal reference generating circuits, which prevents the circuit area from increasing.

(2) The level trimming circuit 7 in the internal reference generating circuit 3 generates the second reference voltage Vflat2 in which variation in the first reference voltage Vflat1 has been compensated for, and supplies the second reference voltage Vflat2 to the internal reference voltage generating circuit 8. The internal reference voltage generating circuit 8 generates first to third internal reference voltages Vflat3*a*, Vflat3*b* and Vflat3*c* using the second reference voltage Vflat2. In this case, the loads of first to third voltage-drop regulators 4–6 are not applied to the non-inverting input terminal of the differential amplifier 11 of the level trimming circuit 7. This suppresses a variation in the load, such that the phase compensation circuit 14 prevents the oscillation of the level trimming circuit 7.

Since there are no transfer gates between the non-inverting input terminal of the differential amplifier 21 and the voltage dividing circuit 23 of the internal reference voltage generating circuit 8, the load to the non-inverting input terminal of the differential amplifier 21 does not vary. Accordingly, the phase compensation circuit 24 prevents the oscillation of the internal reference voltage generating circuit 8.

(3) The feedback voltage Vf2 is supplied to the non-inverting input terminal of the differential amplifier 21 of the internal reference voltage generating circuit 8. By properly changing the feedback voltage Vf2, first to third internal reference voltages Vflat3*a*, Vflat3*b* and Vflat3*c* can be altered adequately.

Figure 10:
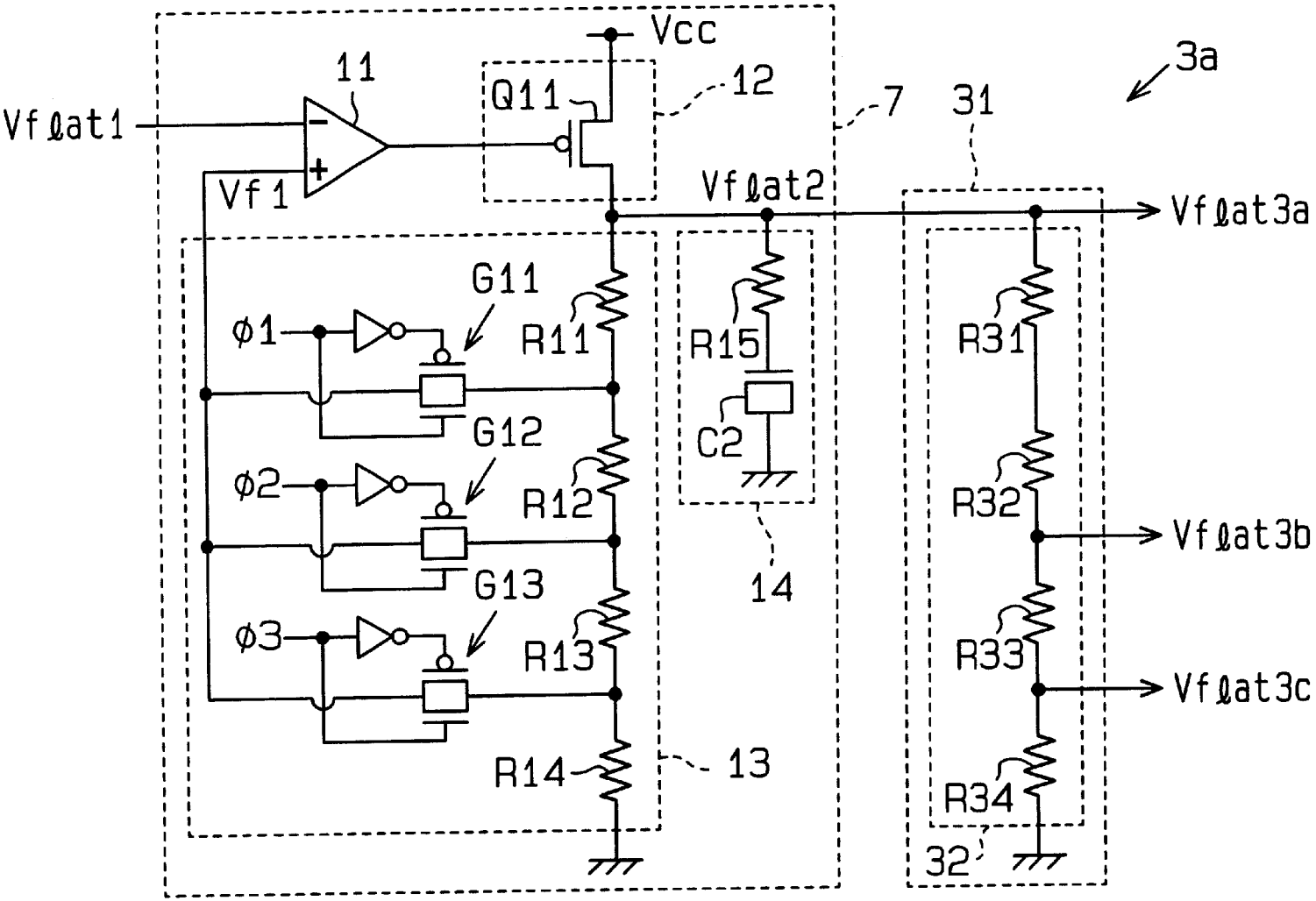
FIG. 10 is a schematic circuit diagram of a reference voltage generating circuit of an internal supply voltage generating circuit according to a second embodiment of the present invention.

As shown in FIG. 10, a reference voltage generating circuit 3*a* of an internal supply voltage generating circuit according to a second embodiment of the present invention includes a voltage dividing circuit 32 having four resistors R31, R32, R33 and R34. The reference voltage generating circuit 3*a* does not have the differential amplifier 21, the driver 22 and the phase compensation circuit 24 of the first embodiment. In the second embodiment, the first internal reference voltage Vflat3*a*, which is supplied to the first voltage-drop regulator 4 (in FIG. 7), coincides with the second reference voltage Vflat2 generated by the level trimming circuit 7. Therefore, it is unlikely for the first internal reference voltage Vflat3*a* to be higher than the second reference voltage Vflat2.

The second embodiment further suppresses an increase in the circuit area by an amount equivalent to the area occupied by the omitted driver 22 and the phase compensation circuit 24.

Figure 11:
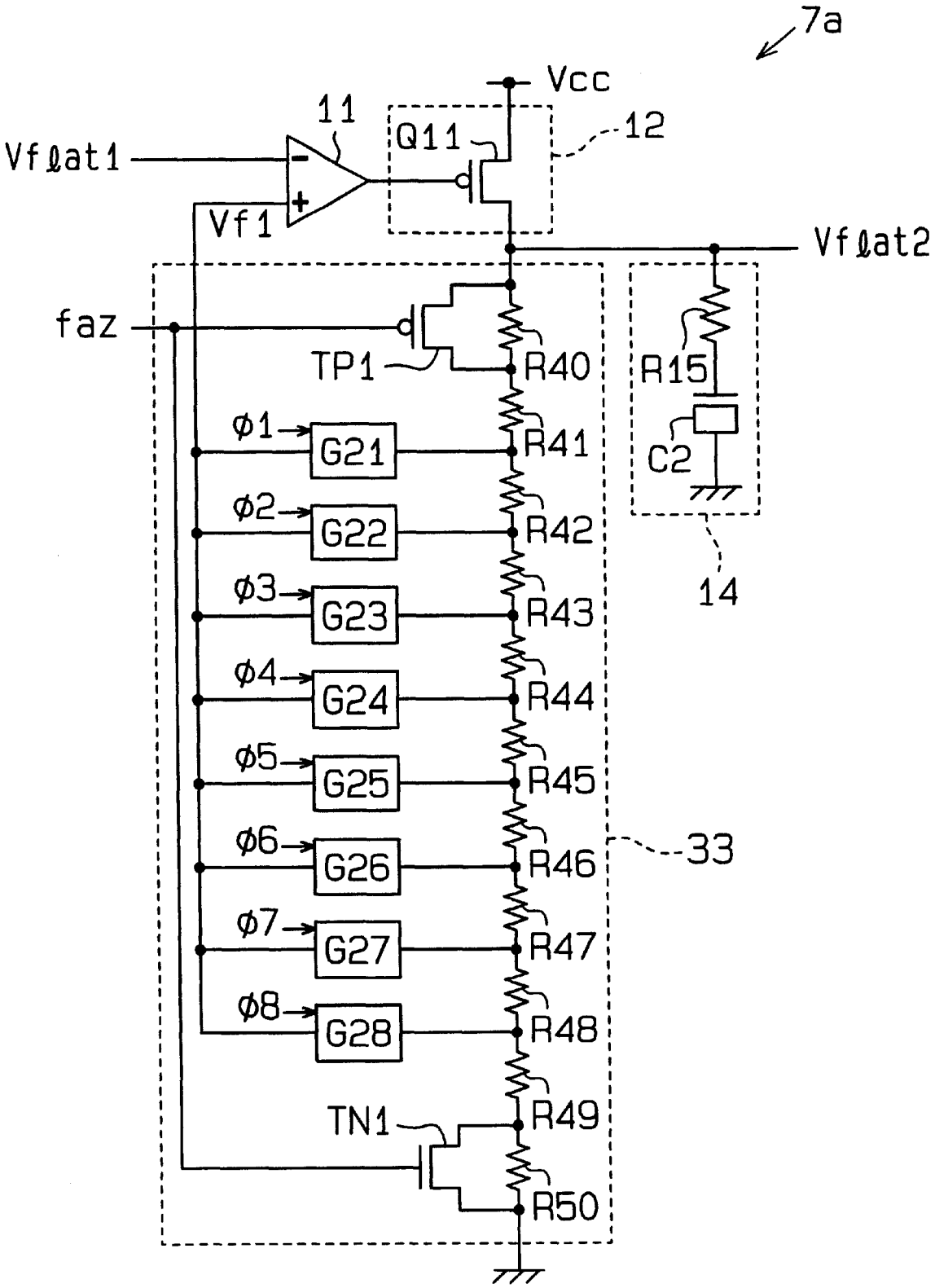
FIG. 11 is a schematic circuit diagram of a level trimming circuit according to a third embodiment of the present invention.

As shown in FIG. 11, a level trimming circuit 7*a* of an internal supply voltage generating circuit according to a third embodiment of the present invention includes a trimming circuit 33 having a voltage dividing circuit which includes eleven resistors R40, R41, R42, R43, R44, R45, R46, R47, R48, R49 and R50. The nine resistors R41–R49 have the same resistance. The resistance of each of the resistors R40 and R50 is eight times as high as the resistance of each of the resistors R41–R49. The resistances of the resistors R40–R50 can be changed as needed.

A selection circuit includes eight transfer gates G21, G22, G23, G24, G25, G26, G27 and G28, and a PMOS transistor TP1 and a NMOS transistor TN1 as short-circuit switches. The transfer gates G21–G28 are connected between the non-inverting input terminal of the differential amplifier and nodes between the resistors R41–R49. One of the transfer gates G21–G28 is turned on by selection signals $\phi 1$ to $\phi 8$ from a selection control circuit (not shown), and the divided voltage is supplied to the non-inverting input terminal of the differential amplifier 11 as the feedback voltage Vf1 via the turned-on transfer gate.

The PMOS transistor TP1 is connected in parallel to the resistor R40, and the NMOS transistor TN1 is connected in parallel to the resistor R50. A mode select signal faz from the selection control circuit (not shown) is supplied to the respective gates of the PMOS and NMOS transistors TP1 and TN1. When the mode select signal faz has an H level (first mode), the PMOS transistor TP1 is turned off and the NMOS transistor TN1 is turned on. When the mode select signal faz has an L level (second mode), the PMOS transistor TP1 is turned on and the NMOS transistor TN1 is turned off.

In the first mode, eight types of feedback voltages Vf1 are selectable in a range from 8·Vflat2/17 volt to Vflat2/17 volt.

In the second mode, eight types of feedback voltages Vf1 are selectable in a range from 16·Vflat2/17 volt to 9·Vflat2/17 volt.

Figure 6:
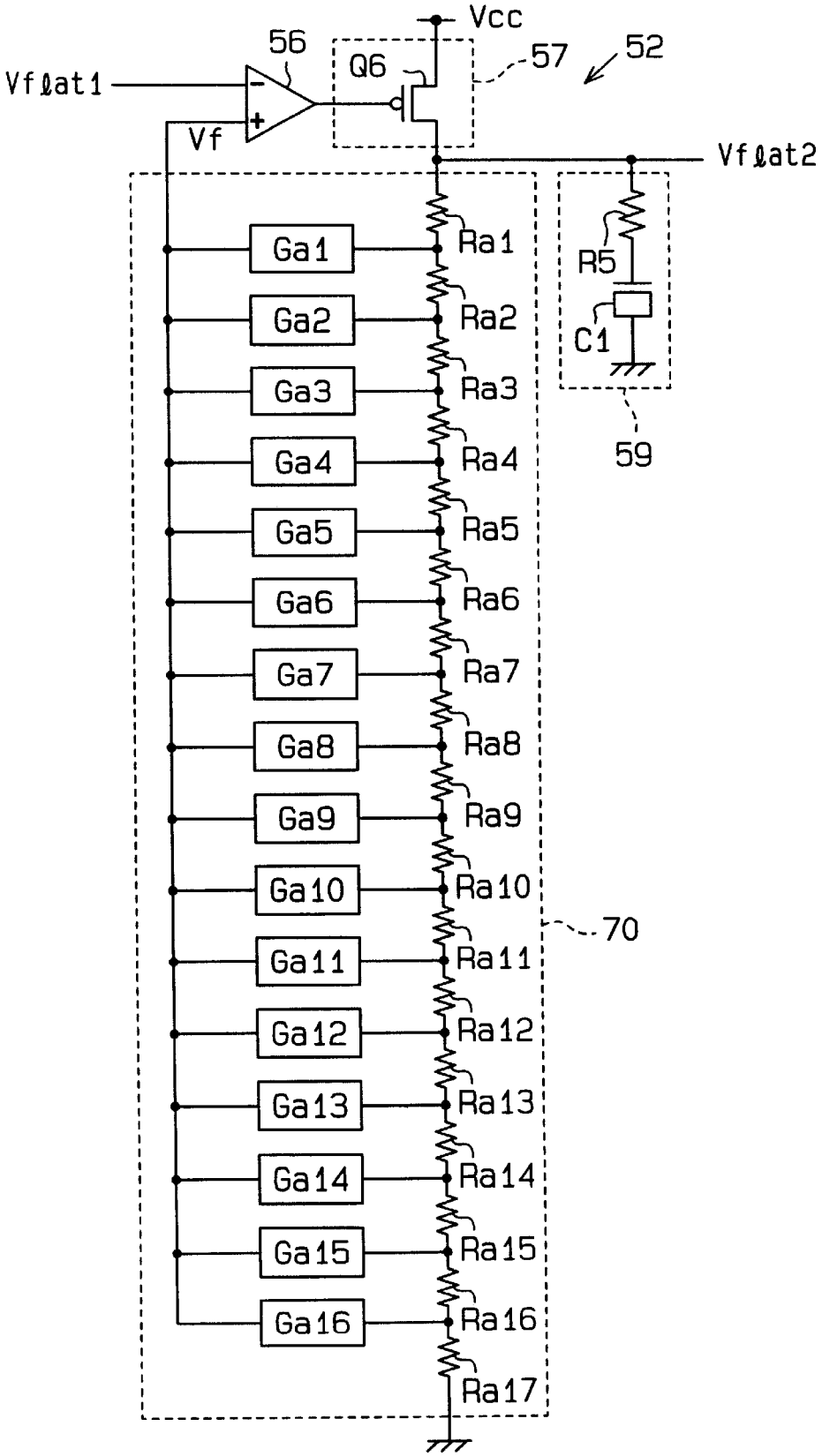
Fig.6 (Prior Art)
FIG. 6 is a schematic circuit diagram of another internal reference generating circuit according to the prior art.

The combination of the mode select signal faz and the selection signals φ1–φ8 can provide sixteen possible ways of selecting the feedback voltage Vf. This allows the first reference voltage Vflat1 to be adjusted more precisely, thus producing a more accurate second reference voltage Vflat2. Furthermore, the number of resistor elements in the voltage dividing circuit, the number of transfer gates in the selection circuit, and of the number of signal lines for the selection signals φ1–φ8 in the trimming circuit of FIG. 11 are considerably smaller than those in the internal reference generating circuit 52 of FIG. 6. This prevents an increase in the circuit area.

It should be apparent to those skilled in the art that the present invention may be embodied in many other forms without departing from the principle and scope of the invention. Particularly, it should be understood that the invention may be embodied in the following forms.

The internal reference generating circuit 3 (in FIG. 7) may be constructed to include the reference voltage generating circuit 3*a* of FIG. 10 and the level trimming circuit 7*a* of FIG. 11. In this case, the circuit area is further reduced.

The present invention may be adapted not only to an internal supply voltage generating circuit for a SDRAM, but also to internal supply voltage generating circuits for other types of semiconductor memory devices and semiconductor devices.

The number of voltage-drop regulators is not limited in any way, and may be one or two, four or more.

Therefore, the present examples and embodiments are to be considered as illustrative and not restrictive. The present invention is not to be limited to the details given herein, but may be modified within the scope and equivalence of the appended claims.

What is claimed is:

1. An internal supply voltage generating circuit comprising:

a level trimming circuit for regulating a first reference voltage and generating a predetermined second reference voltage; and an internal reference voltage generating circuit, connected to the level trimming circuit, for generating one or more internal reference voltages using the predetermined second reference voltage, wherein the level trimming circuit includes:

a differential amplifier for receiving the first reference voltage and a feedback voltage and generating a differential output voltage;

a driver, connected to the differential amplifier, for generating the predetermined second reference voltage in response to the differential output voltage;

a voltage dividing circuit, connected to the driver, for dividing the predetermined second reference voltage and generating a plurality of divided voltages; and a selection circuit, connected between the voltage dividing circuit and the differential amplifier, for selecting at least one of the plurality of divided voltages and supplying the selected at least one divided voltage to the differential amplifier as the feedback voltage.

2. An internal supply voltage generating circuit comprising:

a level trimming circuit for regulating a first reference voltage and generating a predetermined second reference voltage; and an internal reference voltage generating circuit, connected to the level trimming circuit, for generating one or more internal reference voltages using the predetermined second reference voltage, wherein the internal reference voltage generating circuit includes:

a differential amplifier for receiving the predetermined second reference voltage and a feedback voltage and generating a differential output voltage;

a driver, connected to the differential amplifier, for generating a first internal reference voltage in response to the differential output voltage; and a voltage dividing circuit, connected to the driver, for dividing the first internal reference voltage and generating a plurality of divided voltages including at least one second internal reference voltage.

3. An internal supply voltage generating circuit comprising:

a level trimming circuit for regulating a first reference voltage and generating a predetermined second reference voltage; and an internal reference voltage generating circuit, connected to the level trimming circuit, for generating one or more internal reference voltages using the predetermined second reference voltage, wherein the level trimming circuit includes:

a voltage dividing circuit for dividing the predetermined second reference voltage and generating a plurality of divided voltages, the voltage dividing circuit including, a first resistor, a plurality of second resistors having the same resistance, wherein one of the second resistors is connected to the first resistor, and a third resistor connected to another one of the second resistors, wherein a resistance of either of the first and third resistors is larger than a resistance of any of the plurality of second resistors;

a first short-circuit switch connected in parallel to the first resistor; and a second short-circuit switch connected in parallel to the third resistor.

4. An internal supply voltage generating circuit comprising:

a level trimming circuit for regulating a first reference voltage and generating a predetermined second reference voltage, wherein the level trimming circuit includes a voltage dividing circuit for dividing the predetermined second reference voltage and generating a plurality of divided voltages, and wherein the level trimming circuit regulates the first reference voltage using at least one divided voltage selected from the plurality of divided voltages as a feedback voltage;

an internal reference voltage generating circuit, connected to the level trimming circuit, for generating one or more internal supply voltages using the predetermined second reference voltage; and a phase compensation circuit, connected between the level trimming circuit and the internal reference voltage generating circuit, for compensating for a phase shift of the feedback voltage, wherein the level trimming circuit includes:

a differential amplifier for receiving the first reference voltage and the feedback voltage and generating a differential output voltage;

a driver, connected to the differential amplifier, for generating the predetermined second reference voltage in response to the differential output voltage;

a voltage dividing circuit, connected to the driver, for dividing the predetermined second reference voltage and generating the plurality of divided voltages; and a selection circuit, connected between the voltage dividing circuit and the differential amplifier, for selecting at least one of the plurality of divided voltages and supplying the selected at least one divided voltage to the differential amplifier as the feedback voltage.

5. An internal supply voltage generating circuit comprising:

a level trimming circuit for regulating a first reference voltage and generating a predetermined second reference voltage, wherein the level trimming circuit includes a voltage dividing circuit for dividing the predetermined second reference voltage and generating a plurality of divided voltages, and wherein the level trimming circuit regulates the first reference voltage using at least one divided voltage selected from the plurality of divided voltages as a feedback voltage;

an internal reference voltage generating circuit, connected to the level trimming circuit, for generating one or more internal supply voltages using the predetermined second reference voltage; and a phase compensation circuit, connected between the level trimming circuit and the internal reference voltage generating circuit, for compensating for a phase shift of the feedback voltage, wherein the internal reference voltage generating circuit includes:

a differential amplifier for receiving the predetermined second reference voltage and the feedback voltage and generating a differential output voltage;

a driver, connected to the differential amplifier, for generating a first internal reference voltage in response to the differential output voltage; and a voltage dividing circuit, connected to the driver, for dividing the first internal reference voltage and generating the plurality of divided voltages including at least one second internal reference voltage.

6. An internal supply voltage generating circuit comprising:

a level trimming circuit for regulating a first reference voltage and generating a predetermined second reference voltage, wherein the level trimming circuit includes a voltage dividing circuit for dividing the predetermined second reference voltage and generating a plurality of divided voltages, and wherein the level trimming circuit regulates the first reference voltage using at least one divided voltage selected from the plurality of divided voltages as a feedback voltage;

an internal reference voltage generating circuit, connected to the level trimming circuit, for generating one or more internal supply voltages using the predetermined second reference voltage; and a phase compensation circuit, connected between the level trimming circuit and the internal reference voltage generating circuit, for compensating for a phase shift of the feedback voltage, wherein the level trimming circuit includes:

a voltage dividing circuit for dividing the predetermined second reference voltage and generating the plurality of divided voltages, wherein the voltage dividing circuit including, a first resistor, a plurality of second resistors having the same resistance, wherein one of the second resistors is connected to the first resistor, and a third resistor connected to another one of the second resistors, wherein a resistance of either of the first and third resistors is larger than a resistance of any of the plurality of second resistors;

a first short-circuit switch connected in parallel to the first resistor; and a second short-circuit switch connected in parallel to the third resistor.

7. A method for generating an internal supply voltage, comprising:

generating a first reference voltage from an external supply voltage;

generating a predetermined second reference voltage by regulating the first reference voltage;

compensating for a phase shift of the predetermined second reference voltage to generate a compensated predetermined second reference voltage;

generating a plurality of internal reference voltages using the compensated predetermined second reference voltage and a single internal reference voltage generating circuit; and generating a plurality of internal supply voltages using the plurality of internal reference voltages.

8. An internal supply voltage generating circuit comprising:

a level trimming circuit for regulating a first reference voltage and generating a predetermined second reference voltage, wherein the level trimming circuit includes a voltage dividing circuit for dividing the predetermined second reference voltage and generating a plurality of divided voltages, wherein the level trimming circuit regulates the first reference voltage using at least one divided voltage selected from the plurality of divided voltages as a feedback voltage, and wherein the level trimming circuit further includes a phase compensation circuit for compensating for a phase shift of the feedback voltage; and an internal reference voltage generating circuit, connected to the level trimming circuit, for generating a plurality of internal reference voltages using the predetermined second reference voltage.

9. The internal supply voltage generating circuit according to claim 8, wherein the level trimming circuit selects the feedback voltage in accordance with one of a fixed control signal and a variable control signal according to a test mode.

10. The internal supply voltage generating circuit according to claim 8, wherein the level trimming circuit includes:

a differential amplifier for receiving the first reference voltage and the feedback voltage and generating a differential output voltage;

a driver, connected to the differential amplifier, for generating the predetermined second reference voltage in response to the differential output voltage; and a selection circuit, connected between the voltage dividing circuit and the differential amplifier, for selecting at least one of the plurality of divided voltages and supplying the selected at least one divided voltage to the differential amplifier as the feedback voltage.

11. The internal supply voltage generating circuit according to claim 8, wherein the internal reference voltage generating circuit includes:

a differential amplifier for receiving the predetermined second reference voltage and the feedback voltage and generating a differential output voltage;

a driver, connected to the differential amplifier, for generating a first internal reference voltage in response to the differential output voltage; and a second voltage dividing circuit, connected to the driver, for dividing the first internal reference voltage and generating a plurality of second divided voltages including at least one second internal reference voltage.

12. The internal supply voltage generating circuit according to claim 8, wherein the internal reference voltage generating circuit includes a second voltage dividing circuit for outputting the predetermined second reference voltage as a first internal reference voltage and dividing the predetermined second reference voltage to generate at least one second internal reference voltage.

13. The internal supply voltage generating circuit according to claim 8, wherein the voltage dividing circuit includes, a first resistor, a plurality of second resistors having a same resistance, wherein one of the second resistors is connected to the first resistor, and a third resistor connected to another one of the second resistors, wherein a resistance of either of the first and third resistors is larger than a resistance of any of the plurality of second resistors, and wherein the level trimming circuit includes, a first short-circuit switch connected in parallel to the first resistor; and a second short-circuit switch connected in parallel to the third resistor.

14. An internal supply voltage generating circuit comprising:

a level trimming circuit for regulating a first reference voltage and generating a predetermined second reference voltage, wherein the level trimming circuit includes a voltage dividing circuit for dividing the predetermined second reference voltage and generating a plurality of divided voltages, and wherein the level trimming circuit regulates the first reference voltage using at least one divided voltage selected from the plurality of divided voltages as a feedback voltage;

an internal reference voltage generating circuit, connected to the level trimming circuit, for generating a plurality of internal supply voltages using the predetermined second reference voltage; and a phase compensation circuit, connected between the level trimming circuit and the internal reference voltage generating circuit, for compensating for a phase shift of the feedback voltage.

15. The internal supply voltage generating circuit according to claim 14, wherein the level trimming circuit selects the feedback voltage in accordance with one of a fixed control signal and a variable control signal according to a test mode.

16. The internal supply voltage generating circuit according to claim 15, wherein the level trimming circuit includes:

a differential amplifier for receiving the first reference voltage and the feedback voltage and generating a differential output voltage;

a driver, connected to the differential amplifier, for generating the predetermined second reference voltage in response to the differential output voltage;

a voltage dividing circuit, connected to the driver, for dividing the predetermined second reference voltage and generating the plurality of divided voltages; and a selection circuit, connected between the voltage dividing circuit and the differential amplifier, for selecting at least one of the plurality of divided voltages and supplying the selected at least one divided voltage to the differential amplifier as the feedback voltage.

17. The internal supply voltage generating circuit according to claim 14, wherein the internal reference voltage generating circuit includes:

a differential amplifier for receiving the predetermined second reference voltage and the feedback voltage and generating a differential output voltage;

a driver, connected to the differential amplifier, for generating a first internal reference voltage in response to the differential output voltage; and a voltage dividing circuit, connected to the driver, for dividing the first internal reference voltage and generating the plurality of divided voltages including at least one second internal reference voltage.

18. The internal supply voltage generating circuit according to claim 14, wherein the internal reference voltage generating circuit includes a voltage dividing circuit for outputting the predetermined second reference voltage as a first internal reference voltage, and dividing the predetermined second reference voltage and generating at least one second internal reference voltage.

19. The internal supply voltage generating circuit according to claim 14, wherein the level trimming circuit includes:

a voltage dividing circuit for dividing the predetermined second reference voltage and generating the plurality of divided voltages, wherein the voltage dividing circuit including, a first resistor, a plurality of second resistors having a same resistance, wherein one of the second resistors is connected to the first resistor, and a third resistor connected to another one of the second resistors, wherein a resistance of either of the first and third resistors is larger than a resistance of any of the plurality of second resistors;

a first short-circuit switch connected in parallel to the first resistor; and a second short-circuit switch connected in parallel to the third resistor.

* * * * *